United States Patent [19]

DiTullio et al.

[11] 4,100,514

[45] Jul. 11, 1978

[54] BROADBAND MICROWAVE POLARIZER DEVICE

[75] Inventors: Joseph G. DiTullio, Woburn; Leonard I. Parad, Framingham, both of Mass.

[73] Assignee: GTE Sylvania Incorporated, Stamford, Conn.

[21] Appl. No.: 791,969

[22] Filed: Apr. 28, 1977

[51] Int. Cl.[2] ..... H01P 1/18; H01P/1/165; H01P/9/00

[52] U.S. Cl. ..... 333/31 A; 333/21 A;

[58] Field of Search ..... 333/31 R, 31 A, 98 M, 333/98 R, 73 W, 21 R, 21 A, 1, 6

[56] References Cited

U.S. PATENT DOCUMENTS

| | | | |
|---|---|---|---|
| 2,888,598 | 5/1959 | Palluel | 333/31 A X |
| 3,755,760 | 8/1973 | Ohm | 333/31 A |

*Primary Examiner*—Alfred E. Smith
*Assistant Examiner*—Marvin Nussbaum
*Attorney, Agent, or Firm*—Peter Xiarhos

[57] ABSTRACT

A broadband microwave polarizer device for introducing a differential phase shift between orthogonal components of linear orthogonally-polarized signals, the differential phase shift being relatively constant over a wide range of frequencies, for example, a range of frequencies of 5.925GHz to 6.425GHz.

The polarizer device includes a section of waveguide having two opposing rows of pins at inner surface regions thereof, in a first common plane, and two opposing ridges at other inner surface regions thereof in a second common plane transverse to the first plane. By appropriate design of the pins and ridges, a relatively constant resultant phase shift $\phi_R$ may be achieved over the abovementioned bandwidth. The value of $\phi_R$ may be approximated by $$A_O - B_O + (A_1 - B_1)(f - f_O) + (A_2 - B_2)(f - f_O)^2,$$

where $f$ is a selected frequency of the orthogonally-polarized signals, $f$ is the center frequency of the operating frequency bandwidth of the polarizer device, $A_O$, $A_1$ and $A_2$, are constants associated with the two rows of pins of the polarizer device, and $B_O$, $B_1$ and $B_2$ are constants associated with the two ridges of the polarizer device.

6 Claims, 7 Drawing Figures

BROADBAND MICROWAVE POLARIZER DEVICE

BACKGROUND OF THE INVENTION

The present invention relates to a polarizer device and, more particularly, to a broadband microwave polarizer device capable of introducing a relatively constant differential phase shift between orthogonal components of input signals over a wide frequency bandwidth.

Microwave polarizer devices for introducing phase shifts between orthogonal components of signals are well known to those skilled in the art. For example, polarizer devices have been constructed using either pins, ridges or thin dielectric vanes (e.g., of "Teflon") within square or circular sections of waveguide, or by using sections of waveguide which are not circular or square, such as elliptical or slightly non-square sections of waveguide. In the case of pin-type polarizer devices, a pair of opposing rows of spaced-apart pins are normally arranged in a common plane in a section of waveguide and the phase shift introduced thereby may be approximated by $$\phi_p = A_0 + A_1(f-f_0) + A_2(f-f_0)^2,$$

where $f$ is the frequency of input signals applied to the polarizer device, $f_0$ is the center frequency of the operating range of frequencies (bandwidth) of the polarizer device, and $A_0$, $A_1$ and $A_2$ are constants, the values of which are determined by such factors as the number, cross section, depth and spacing of the pins. In a similar fashion, in the case of ridge-type polarizer devices, a pair of elongated opposing ridges are normally arranged in a common plane in a section of waveguide and the phase shift introduced thereby may be approximated by $$\phi_r = B_0 + B_1(f-f_0) + B_2(f-f_0)^2,$$

where $f$ is the frequency of input signals applied to the polarizer device, $f_0$ is the center frequency of the operating range of frequencies of the polarizer device, and $B_0$, $B_1$ and $b_2$ are constants, the values of which are determined by such factors as the depth, shape and thickness of the ridges.

In the design of a pin-type polarizer device as described above, it is generally desirable to make all of the constants except $A_0$ as small as possible so that the phase shift introduced by the polarizer device does not vary significantly over the entire bandwidth. This result may be accomplished by making the value of the constant $A_1$ equal to 0, for example, by the appropriate selection of characteristics for the pins of the polarizer device. However, although the value of the constant $A_1$ may be made equal to 0, it is difficult at the same time to make the value of the constant $A_2$ small. As a result, the phase shift introduced by the pin-type polarizer over the entire frequency bandwidth varies excessively, for example, by several degrees. In a similar fashion, it is difficult to control the values of the constants $B_0$, $B_1$ and $B_2$ for a ridge-type polarizer device, with the result that the phase shift introduced by the polarizer device also varies by several degrees over the entire frequency bandwidth of the polarizer device. The aforementioned elliptical or slightly non-square waveguides also introduce phase shifts which vary by several degrees over the entire frequency bandwidth.

BRIEF SUMMARY OF THE INVENTION

In accordance with the present invention, it has been discovered that if the phase shift of a ridge-type polarizer design, as represented by the expression for $\phi_r$, is subtracted from the phase shift of a pin-type polarizer design as represented by the expression for $\phi_p$ and, in addition, the constant $A_1$ is made negative and equal in value to the constant $B_1$, $B_1$ being a negative constant and the constants $A_2$ and $B_2$ are positive and essentially equal in value, a resultant phase shift $\phi_R$ equal to $\phi_p - \phi_r$ may be achieved which is relatively constant over a wide frequency bandwidth. In this case, the phase shift $\phi_R$ may be approximated by $$\phi_R = \phi_p - \phi_r - A_0 - B_0 + (A_1 - B_1)(f-f_0) + (A_2 - B_2)(f-f_0)^2,$$

where $f$ is the frequency of signals having orthogonal components between which a phase shift is to be introduced in accordance with the above equation for $\phi_R$, $f_0$ is the center frequency of the frequency bandwidth over which phase shifting may take place, $A_0$, $A_1$ and $A_2$ are constants associated with a pin-type polarizer design, and $B_0$, $B_1$ and $B_2$ are constants associated with a ridge-type polarizer design.

A polarizer device which satisfies the above equation for $\phi_R$ in accordance with the present invention includes a section of waveguide, a pair of opposing rows of pins at inner surface regions of the waveguide, and a pair of opposing ridges at other inner surface regions of the waveguide. The rows of pins are in a common, first plane and the pair of ridges are in a common second plane at an angle to the first plane. The polarizer device operates in accordance with the invention to introduce a phase shift between orthogonal components of signals applied to an input end of the section of waveguide and to present the phase shifted orthogonal components of the signals at an output end of the section of waveguide. To achieve a relatively constant value for $\phi_R$ over the frequency bandwidth of the polarizer device in accordance with the invention, the characteristics of the rows of pins and the pair of ridges are selected so that the constants $A_1$ and $B_1$ are negative with the value of the constant $A_1$ being equal to the value of the constant $B_1$, and so that the constants $A_2$ and $B_2$ are positive and essentially equal in value. In this situation, the value of the phase shift $\phi_R$ accordingly becomes approximately equal to the value of $A_0$–$B_0$.

BRIEF DESCRIPTION OF THE DRAWING

Various objects, features and advantages of a broadband microwave polarizer device in accordance with the present invention will be apparent from the following detailed discussion taken in conjunction with the accompanying drawing in which.

DETAILED DESCRIPTION OF THE INVENTION

Figure 1:
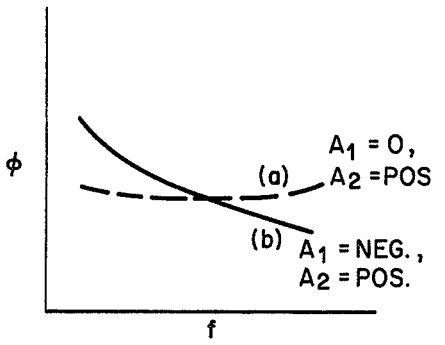
FIG. 1 illustrates curves of phase shift $\phi_p$ versus frequency $f$ for a pin-type polarizer device.
Figure 2:
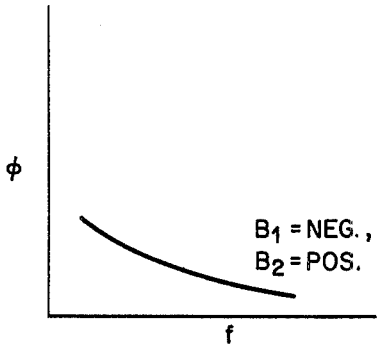
FIG. 2 illustrates a curve of phase shift $\phi_r$ versus frequency $f$ for a ridge-type polarizer device.
Figure 3:
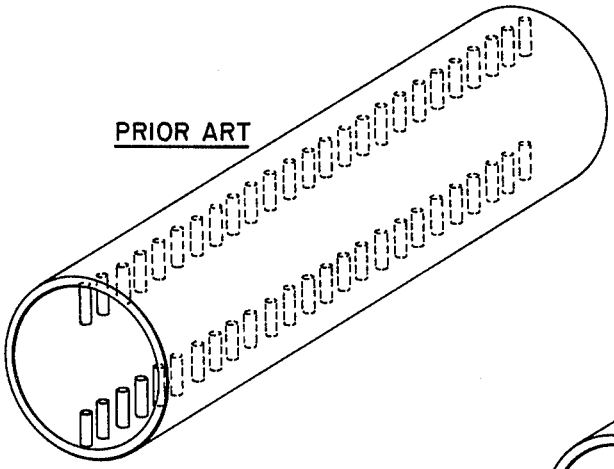
FIG. 3 is a perspective view of a prior art pin-type polarizer device.
Figure 4:
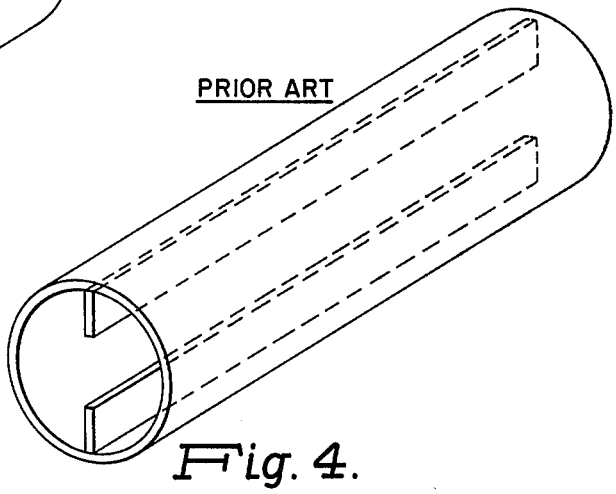
FIG. 4 is a perspective view of a prior art ridge-type polarizer device.

Referring now to FIGS. 1 and 2, there are shown generalized curves of phase shift versus frequency for a standard pin-type polarizer device, such as shown in FIG. 3, and for a standard ridge-type polarizer device, such as shown in FIG. 4. As mentioned previously in the section entitled "Background of the Invention", the phase shift equation for a pin-type polarizer device may be generally approximated by $$\phi_p = A_0 + A_1 (f-f_0) + A_2 (f-f_0)^2$$

and for a ridge-type polarizer device by $$\phi_r = B_0 + B_1 (f-f_0) + B_2 (f-f_0)^2.$$

In the usual design of a pin-type polarizer device, which typically includes a pair of opposed rows of spaced-apart pins in a common plane as shown in FIG. 3, the constant $A_1$ in the equation for $\phi_p$ is made to equal zero, as by selecting appropriate lengths for the pins of the polarizer device. The value of the constant $A_0$ is principally a function of the number of pins and is determined in conjunction with the lengths of the pins. The constant $A_2$ is positive but in actual practice it is difficult to make the value of the constant small. As a result, the phase shift $\phi_p$ introduced by the polarizer device varies widely over the entire frequency bandwidth.

In the usual design of a ridge-type polarizer device, which includes a pair of opposed ridges as shown in FIG. 4, the constant $B_1$ is negative and the value of the constant $B_2$ is positive. The curve for this case is illustrated in FIG. 2. The values of the constants $B_0$, $B_1$ and $B_2$ are determined by the characteristics of the ridges employed in the polarizer device, such as the shape, depth and thickness of the ridges. In the design of a ridge-type polarizer device, there is much less control over the values of the constants $B_0$, $B_1$ and $B_2$ than is possible with a pin-type polarizer device. As a result, the phase shift $\phi_r$ introduced by the polarizer device also varies widely over the entire frequency bandwidth.

In accordance with the present invention, it has been discovered that if both pins and ridges are employed in a single section of waveguide so that the phase shift contributions of the pins and ridges are subtractive, specifically, the value of the phase shift $\phi_r$ is subtracted from the value of the phase shift $\phi_p$, and, in addition, the constant $A_1$ is made to be negative and equal in value to the constant $B_1$ (which is also negative and the constants $A_2$ and $B_2$ are positive and equal in value, a resultant phase shift $\phi_R$ may be achieved which is relatively constant (less than 1°) over the entire frequency bandwidth of the polarizer device employing the pins and ridges. The phase shift $\phi$ may be approximated by $$\phi_R = \phi_p - O_r = A_0 - B_0 + (A_1 + B_1)(f - f_0) + (A_2 - B_2)(f - f_0)^2,$$

where $f$ is the frequency of input signals having orthogonal components between which a phase shift is to be introduced by the polarizer device, $f_0$ is the center frequency of the bandwidth of the polarizer device, $A_0$, $A_1$ and $A_2$ are constants associated with the pins of the polarizer device, and $B_0$, $B_1$ and $B_2$ are constants associated with the ridges of the polarizer device.

Figure 5:
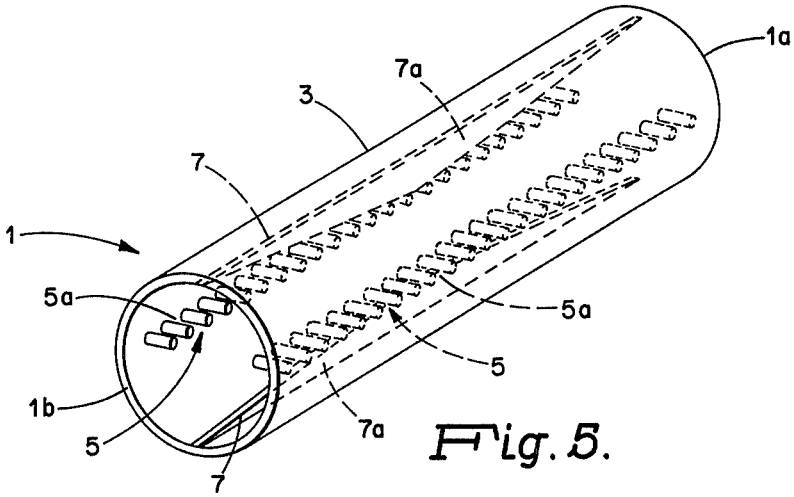
FIG. 5 is a perspective view of a broadband microwave polarizer device in accordance with the present invention.
Figure 6:
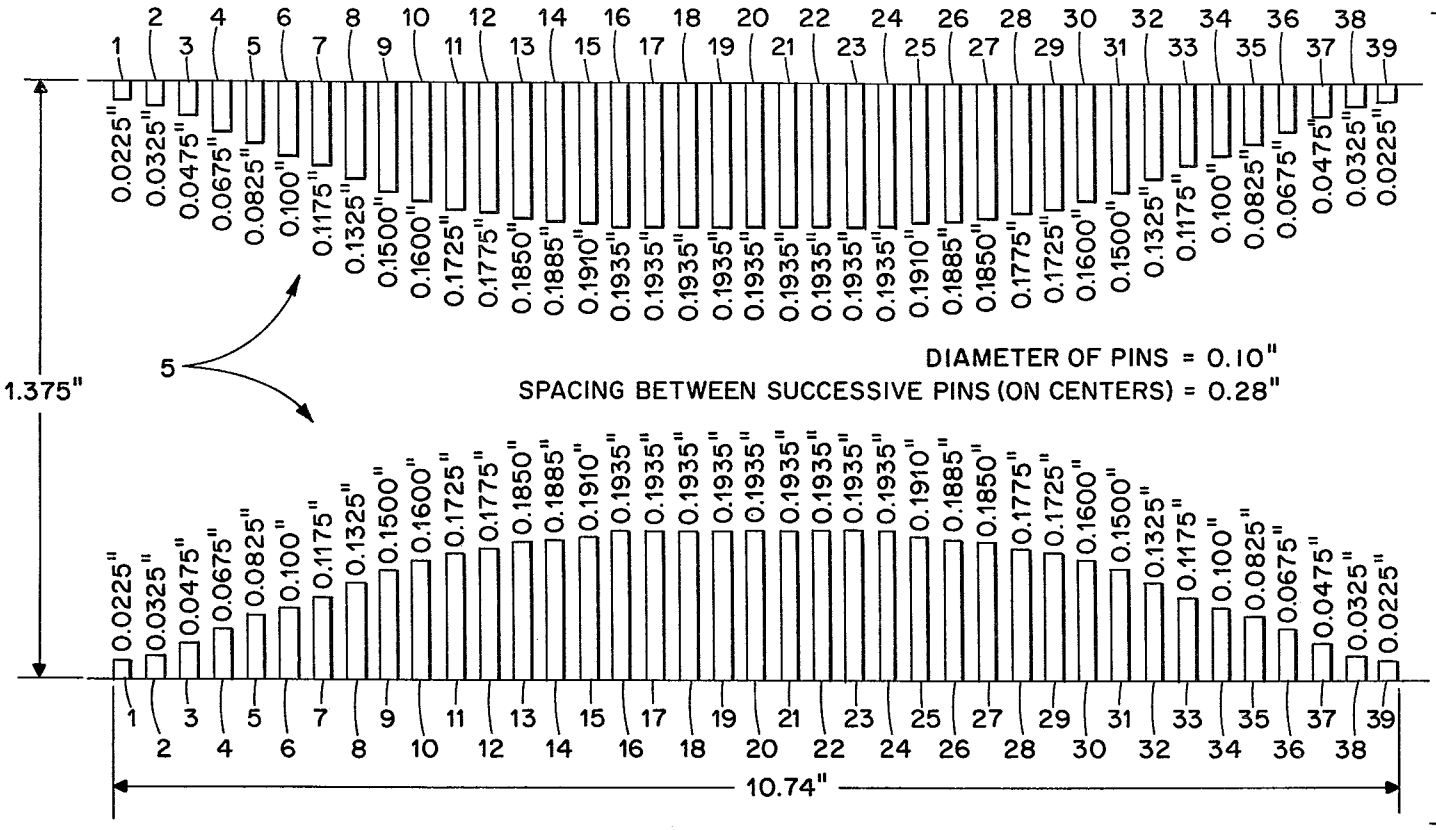
FIG. 6 illustrates details of a pair of rows of pins employed in the polarizer device of FIG. 5.
Figure 7:
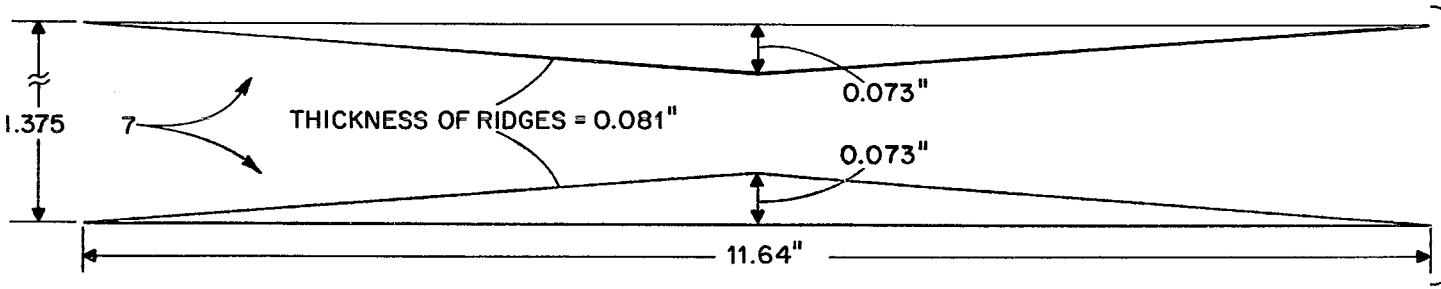
FIG. 7 illustrates details of a pair of ridges employed in the polarizer device of FIG. 5.

FIG. 5 illustrates in a perspective view a broadband microwave polarizer device 1 in accordance with the invention which satisfies the equation for $\phi_R$ as set forth hereinabove. As shown in FIG. 5, the polarizer device 1 generally includes a length or section of circular waveguide 3 having a pair of opposing rows of cylindrical, spaced-apart pins 5 at first inner surface regions 5a and a pair of opposing ridges 7 at second inner surface regions 7a. The pair of rows of pins 5, which are shown in detail in FIG. 6, are arranged in a common first plane and, similarly, the pair of ridges 7, which are shown in detail in FIG. 7, are arranged in a common second plane transverse to the first plane.

The polarizer device 1 as described above is adapted to receive input signals at a first end or input port 1a and to introduce a phase shift between the orthogonal components of these signals at a second end or output port 1b. In one specific design of the polarizer device 1, by which the polarizer device 1 may function as a 90° circular polarizer device and transform a pair of linear, orthogonally-polarized input signals to a pair of oppositely-rotating circularly-polarized signals, the polarizer device 1 has a waveguide section of a diameter (inside) of 1.375 in., two rows of 39 spaced-apart pins 5 of varying heights over a total length of 10.74 in., and two inverted V-shaped ridges 7. Each of the 39 pins has a diameter of 0.100 in. and the pins 5 are spaced from each other (on centers) by a distance of 0.280 in. The heights of the various pins are set forth in FIG. 6 from which it will be noted that the lengths of the pins 5 increase in the direction of the center of the section of waveguide, remain constant at the center, and then decreased again, in the direction of the output end of the section of waveguide. Each of the ridges 7 is 11.64 in. in length, has a maximum height at the center of its length of 0.073 in. and a thickness of 0.081 in., as indicated in FIG. 7. The ridges 7 are accordingly V-shaped and inverted with respect to each other. In the above specific design for the polarizer device 1, the constant $A_1$, which is determined principally by the lengths of the pins 5, is negative as indicated in the curve (b) of FIG. 1, and has a value equal to the negative constant $B_1$ as represented by the curve of FIG. 2. Accordingly, the value of $A_1 - B_1$ is equal to zero. The abovestated dimensions for the pins 5 and the ridges 7 (see FIGS. 6 and 7) also result in a value of $A_2 - B_2$ which is also very small, with the result that the phase shift $\phi_R$ is approximately equal to the value of $A_0 - B_0$. With the above design, the value of $A_0 - B_0$ is equal to 90° ±0.8° over a frequency bandwidth of 5.925 Ghz to 6.425 Ghz.

Other variations of the abovedescribed polarizer device 1 are also possible. For example, in lieu of ridges, the polarizer device could employ an elliptical waveguide with appropriately designed pins. The polarizer device could also employ a square waveguide with appropriately designed pins and ridges. By increasing the length of the waveguide and using a greater number of pins and longer ridges, a 90° polarizer device could be made into a 180° polarizer device.

While there has been described what is considered to be a preferred embodiment of the invention, it will be obvious to those skilled in the art that various changes and modifications may be made therein without departing from the invention as called for in the appended claims.

What is claimed is:

1. A broadband microwave polarizer device for introducing a relatively constant phase shift between orthogonal components of signals over a predetermined bandwidth, comprising:

a section of waveguide having an input end for receiving signals having orthogonal components between which a phase shift is to be introduced, and an output end;

a pair of opposing rows of pins at inner surface regions of the waveguide, said rows of pins being in a common, first plane; and a pair of opposing ridges at other inner surface regions of the waveguide, said ridges being in a common, second plane at an angle to the first plane;

said polarizer device being operative to introduce a phase shift between orthogonal components of signals applied to the input end of the section of waveguide, the phase shifted orthogonal components of the signals appearing at the output end of the section of waveguide, the phase shift introduced between the orthogonal components of the signals applied to the section of waveguide being approximated by $$\phi_R = A_0 - B_0 + (A_1 - B_1)(f - f_0) + (A_2 - B_2)(f - f_0)^2,$$

where $f$ is the frequency of the signals applied to the section of waveguide, $f_0$ is the center frequency of the bandwidth over which the polarizer device operates, $A_0$, $A_1$ and $A_2$ are constants associated with the rows of pins, $B_0$, $B_1$ and $B_2$ are constants associated with the pair of opposing ridges;

the characteristics of the rows of pins and the pair of ridges being selected so that the constants $A_1$ and $B_1$ are negative with the value of the constant $A_1$ being equal to the value of the constant $B_1$, and so that the constants $A_2$ and $B_2$ are positive and essentially equal in value, whereby the phase shift introduced between the orthogonal components of signals applied to the section of waveguide is nearly constant over the bandwidth of the polarizer device.

2. A broadband microwave polarizer device in accordance with claim 2 wherein:

the second plane of the ridges is transverse to the first plane of the rows of pins.

3. A broadband microwave polarizer device in accordance with claim 2 wherein:

the pins of each of the rows of pins are of varying heights over the length of the section of waveguide and are spaced from each other in the row; and the ridges are essentially thin, inverted V-shaped ridges.

4. A broadband microwave polarizer device in accordance with claim 3 wherein:

the section of waveguide is circular in configuration.

5. A broadband microwave polarizer device in accordance with claim 3 wherein:

the heights of the pins increase in a direction toward the center of the section of waveguide, remain constant at the center of the section of waveguide, and then decrease in the direction of the output end of the section of waveguide.

6. A broadband microwave polarizer device in accordance with claim 5 wherein:

the pins are generally cylindrical in configuration.

* * * * *